US005218816A

United States Patent [19]

Plemmons et al.

[11] Patent Number: 5,218,816

[45] Date of Patent: Jun. 15, 1993

[54] SEAL EXIT FLOW DISCOURAGER

[75] Inventors: Larry W. Plemmons, Fairfield; Richard A. Wesling, Cincinnati, both of Ohio

[73] Assignee: General Electric Company, Cincinnati, Ohio

[21] Appl. No.: 826,723

[22] Filed: Jan. 28, 1992

[51] Int. Cl.[5] ..... F02C 3/00

[52] U.S. Cl. ..... 60/39.75; 277/53; 415/174.5

[58] Field of Search ..... 415/173.1, 173.4, 173.5, 415/174.2, 174.4, 174.5; 60/39.75, 39.161; 277/53, 55

[56] References Cited

U.S. PATENT DOCUMENTS

| | | | |
|---|---|---|---|
| 3,589,475 | 6/1971 | Alford | 415/119 |
| 4,137,705 | 2/1979 | Anderson | 60/39.75 |
| 4,190,397 | 2/1980 | Schilling et al. | 415/112 |
| 4,320,903 | 3/1982 | Ayache | 415/174.4 |
| 4,815,272 | 3/1989 | Laurello | 60/39.75 |

*Primary Examiner*—Richard A. Bertsch
*Assistant Examiner*—W. J. Wicker
*Attorney, Agent, or Firm*—Jerome C. Squillaro; John R. Rafter

[57] ABSTRACT

A circumferential element discourages the flow of hot gases exiting from a labyrinth or other type of seal in a gas turbine engine. This seal exit flow discourager may be integrally incorporated in the honeycombed seal surface of a labyrinth seal or in the ring supporting the honeycombed seal surface. The seal exit flow discourager has a generally radial surface upon which impinges the jet of hot gases exiting from the labyrinth seal. This surface prevents the exiting hot gases from impinging directly on the low-pressure turbine shaft. At the same time low-temperature air from the compressor is flowing through an annular passageway located between the labyrinth seal and the low-pressure turbine shaft. The seal exit flow discourager diverts the hot gases exiting from the labyrinth seal into the stream of cooling air, thereby causing turbulent mixing of the hot gases and cool air.

17 Claims, 4 Drawing Sheets

SEAL EXIT FLOW DISCOURAGER

FIELD OF THE INVENTION

This invention relates generally to the use of seals in a gas turbine engine. Specifically, the invention relates to an improved mechanism for thermally isolating the low-pressure turbine shaft of a turbofan engine from hot gas exiting from a labyrinth or other type of seal arranged between the high- and low-pressure turbine rotors.

BACKGROUND OF THE INVENTION

In a gas turbine aircraft engine air enters at the engine inlet and flows into the compressor, which compresses the air. Compressed air flows to the combustor where it is mixed with injected fuel and the fuel-air mixture is ignited. The hot combustion gases flow through the turbine. The turbine extracts energy from the hot gases, converting it to power to drive the compressor and any mechanical load connected to the drive.

It is well known to use labyrinth seals in a gas turbine engine to control the flow of gases therethrough. For example, U.S. Pat. No. 3,589,475 to Alford discloses labyrinth seals arranged between rotating and stationary members. Such seals generally comprise a plurality of axially spaced circumferential teeth which extend into sealing relationship with a sealing surface. The seals of Alford are operative to minimize high-pressure fluid leakage from an annular passage into a chamber defined in part by a shaft member and the engine casing.

Although Alford recognized that there would be some leakage of high-pressure fluid from the annular passage through the clearance passages existing between the tip of each tooth and its respective sealing surface and into the chamber, Alford does not discuss the need in some cases to divert the fluid flow upon its exit from the labyrinth seal.

U.S. Pat. No. 4,190,397 to Schilling et al. shows a labyrinth seal arranged immediately aft of the compressor in a gas turbine engine. The turbine portion of the gas turbine engine is typically cooled by air pressurized by the compressor. This coolant air is bled from the compressor flow path through an annular gap between the last stage of compressor rotor blades and the outlet guide vanes and thereafter flows along a frustoconical rotor member into an annular passage in which the labyrinth seal is arranged. The coolant flow rate is metered by the labyrinth seal.

In order to obtain the desired metered amount of coolant flow and yet minimize overall engine performance degradation, the labyrinth seal of Schilling is designed to operate with minimal running clearances between the labyrinth seal teeth and the stationary honeycomb seal material. This minimal clearance causes a temperature rise in the air passing through the seal so that the air exiting the seal loses some of its useful cooling capacity. In addition, where the flanges aft of the labyrinth seal are bolted together, the bolt head and nuts produce turbulent mixing and churning of the coolant flow as it passes over them, creating aerodynamic drag between rotating and static parts and further raising the temperature of the coolant.

In an attempt to minimize any such additional temperature rise caused by such protrusions, Schilling employs an improved windage shield which reduces windage and turbulence. The improved windage shield comprises a continuous ring provided with a plurality of circumferentially spaced recesses having a contour similar to that of the bolt heads. The thickness of the bolt heads and the depth of the recesses are such that the bolt heads form a generally flush interface with the surrounding surfaces of the windage shield, thereby eliminating open access holes and upstream-protruding bolt heads.

Although the Schilling patent recognizes the need to control a property, i.e., the level of aerodynamic drag, of the air flow upon its exit from the labyrinth seal, Schilling does not anticipate the need in some instances to change the direction of that air flow.

SUMMARY OF THE INVENTION

One object of the present invention is to provide a mechanism for minimizing the temperature of the low-pressure turbine shaft at a point downstream of a labyrinth seal arranged between the high- and low-pressure turbine rotors of a gas turbine engine. In particular, it is an object of the invention to provide a mechanism which diverts the jet of hot gases escaping through the labyrinth seal at high velocity, thereby blocking direct impingement of the jet of hot gases on the low-pressure turbine shaft.

A further object of the invention is to provide a mechanism for reducing the temperature of the low-pressure turbine shaft, thereby reducing stress-induced creep, which is a temperature-dependent phenomenon.

Yet another object of the invention is to provide a simple mechanism for reducing the heat transfer coefficient associated with the jet of hot air escaping through the labyrinth seal between the high- and low-pressure turbine rotors.

A further object of the invention is to provide a mechanism for discouraging the flow of hot gases exiting a labyrinth seal, whether that seal is arranged between a rotating member and a stationary member or between two members rotating at different speeds.

Another object of the invention is to provide a mechanism for discouraging the flow of hot gases through a labyrinth seal exit which is inexpensive to manufacture and easy to install. In particular, it is an object to integrally incorporate such a mechanism in a pre-existing component.

It is also an object of the invention to provide a mechanism for mixing cooling air with hot gases leaking into the annular passageway surrounding the low-pressure turbine shaft of a turbofan engine.

A further object of the invention is to minimize the exposure of the low-pressure turbine shaft to hot gases, so that the shaft can be made from less expensive material of relatively lower temperature capability. In addition or in the alternative, the amount of cooling air necessary to cool the shaft can be reduced.

These and other objects are realized in accordance with the invention by providing a seal exit flow discourager which discourages the flow of hot gases through the labyrinth seal between the high- and low-pressure turbine rotors. This seal exit flow discourager is preferably integrally incorporated in either the honeycombed sealing surface of the labyrinth seal or the ring supporting the honeycombed sealing surface. In the alternative, the seal exit flow discourager may comprise a separate ring connected to the seal support ring.

In accordance with the invention, the seal exit flow discourager comprises a circumferential structure having a generally radial surface upon which the jet of hot gases flowing from the labyrinth seal exit impinges. However, it will be appreciated by a practitioner of ordinary skill in the art of gas turbine engines that the surface need not be precisely radial, but rather need only be such that the surface diverts the exiting hot gases from flowing in an axial direction and from impinging directly on the low-pressure turbine shaft. Also it will be appreciated that the material making up the discourager must be able to withstand the high temperature, i.e., in the vicinity of 1000° F., of the hot gases exiting from the labyrinth seal at an approximate speed of Mach 1.

In accordance with the seal exit flow discourager of the invention, a radially inwardly extending flange-like structure is placed in the path of the jet of hot gases exiting from the labyrinth seal. The upstream radial surface of this flange-like structure blocks axial flow of the hot gases in the aft direction and abruptly diverts the hot gas flow radially inward.

At the same time low-temperature air from the compressor is flowing through an annular passageway located between the labyrinth seal and the low-pressure turbine shaft. This low-temperature air is destined to cool the low-pressure turbine. The seal exit flow discourager diverts the hot gases exiting from the labyrinth seal into the stream of cooling air, thereby causing turbulent mixing of the hot gases and cool air.

The resulting mixture of gases has a temperature lower than that of the jet of hot gases exiting the seal. Because the low-pressure turbine shaft is exposed to this low-temperature gas mixture and not the jet of hot gases escaping the seal, temperature-induced creep and metallurgical changes in the shaft material are eliminated.

BRIEF DESCRIPTION OF THE DRAWINGS

These and other advantages of the invention will be better understood when the detailed description of the preferred embodiments of the invention is read in conjunction with the drawings, wherein.

DETAILED DESCRIPTION OF THE PREFERRED EMBODIMENTS

Figure 1:
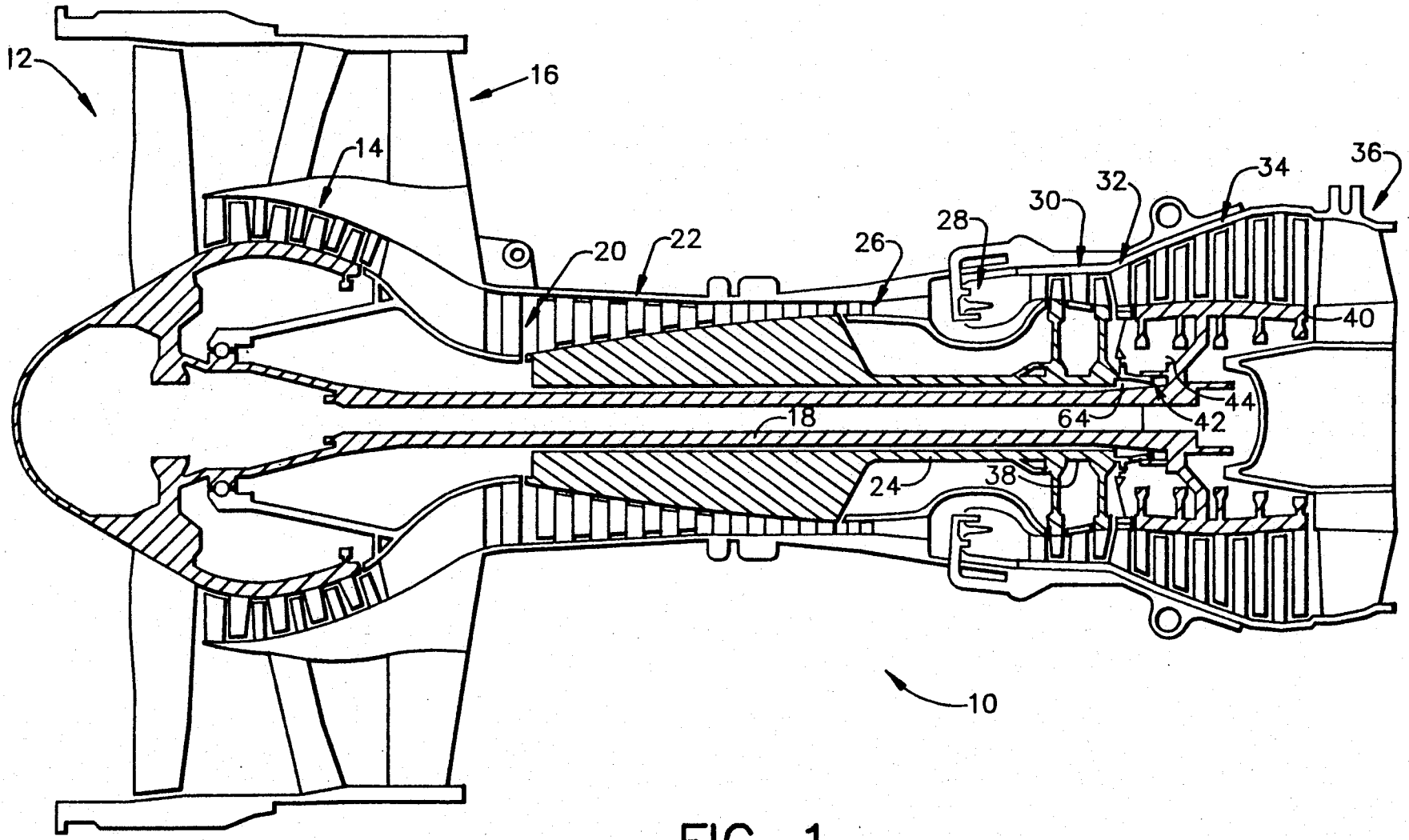
FIG. 1 is a cross-sectional view of a gas turbine engine incorporating a labyrinth seal between the high- and low-pressure turbine rotors.

The preferred embodiments of the invention are incorporated in a turbofan engine of the type depicted in FIG. 1. However, it will be appreciated by the practitioner of ordinary skill that the invention is applicable to any gas turbine engine having a labyrinth seal.

The turbofan engine shown in FIG. 1 is generally designated by the numeral 10. Ambient air enters the fan inlet 12. A portion of the fan airflow enters the low-pressure compressor (LPC) 14 and the remaining portion of the fan airflow bypasses the gas turbine and exits via the fan discharge 16. The LPC 14 raises the pressure and reduces the volume of the air flowing therethrough. LPC 14 is driven by the low-pressure turbine (LPT) 34 by way of the LPT shaft 18. The pressurized air then enters the high-pressure compressor (HPC) inlet 20. The HPC 22 further raises the pressure and reduces the volume of the air. The HPC 22 is driven by the high-pressure turbine (HPT) 30 by way of the HPT shaft 24.

Pressurized air exiting the compressor discharge 26 then enters the combustor 28, into which fuel is injected in spray form, mixed with the air stream and ignited. The resultant combustion causes an increase in gas temperature proportionate to the amount of fuel being injected, a moderate increase in velocity and a negligible decrease in pressure. The rise in energy level of the airflow contributes to the engine thrust.

The dual-stage HPT 30 receives the high-energy gases directly from the combustor. As gases pass through the HPT and reach the LPT entry nozzle 32, they have expanded considerably.

To produce the necessary power to drive the LPC, the LPT 34 is of multi-stage construction with a cross-sectional flow area increasing with each stage. All of the turbine rotor stages are connected to the LPT shaft 18. Thrust is provided by the gases which discharge from the engine via the exhaust nozzle 36.

In the turbofan engine incorporating the invention, the HPT rotor 38 is rotating at about 10,000 rpm and the LPT rotor 40 is rotating at about 4000 rpm. A labyrinth seal 42 is arranged between the HPT and LPT rotors. The function of this seal is to minimize the hot gases escaping from the pressurized cavity 44 into annular passageway 64, thereby reducing engine performance degradation.

Figure 2:
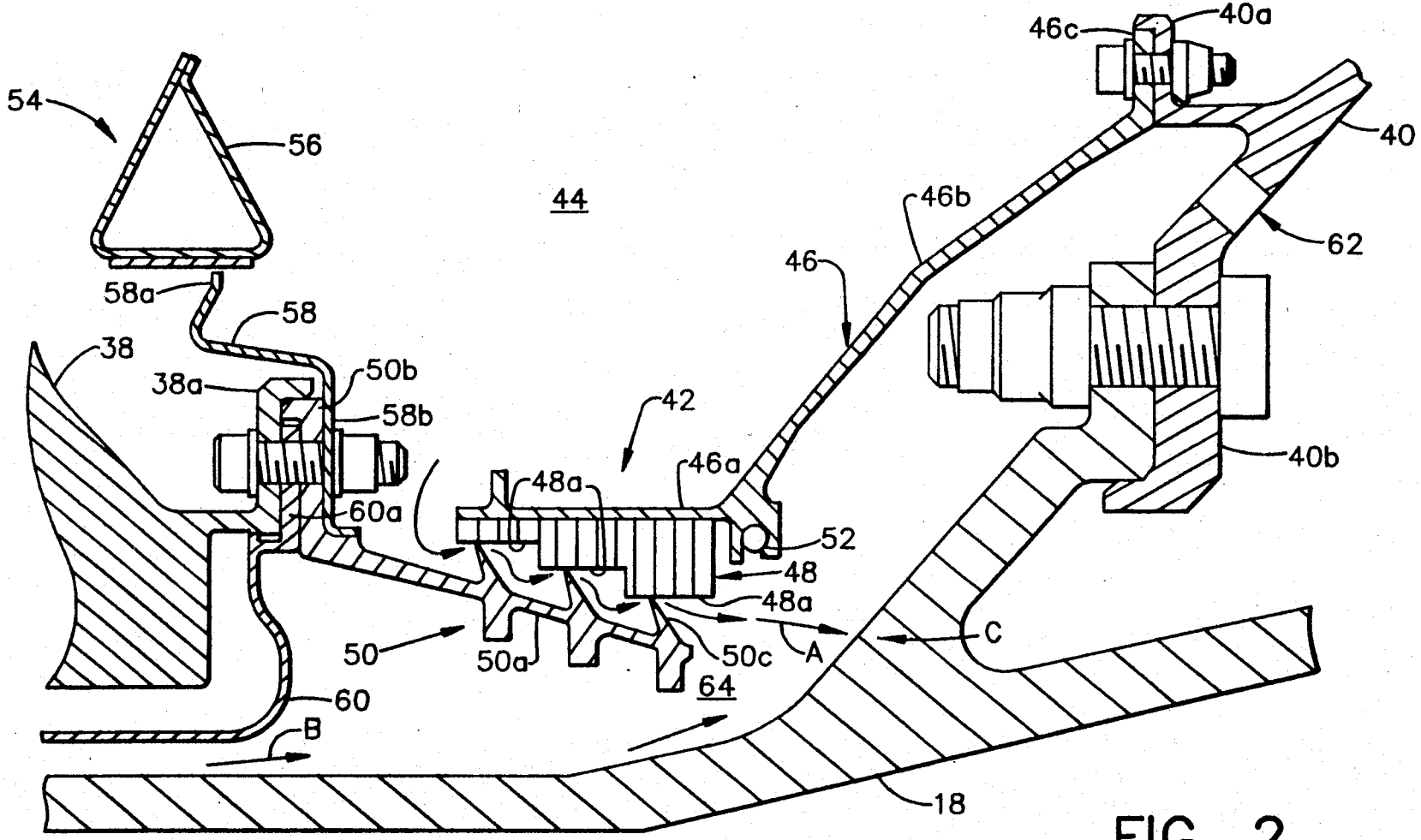
FIG. 2 PRIOR ART
FIG. 2 is an enlarged view of a portion of the engine depicted in FIG. 1 showing a conventional labyrinth seal arrangement.

The structure of a conventional labyrinth seal located between the HPT and LPT rotors of a turbofan engine is shown in FIG. 2. The seal 42 comprises a first seal portion 48 which is supported by a rigid seal support 46 and a second seal portion 50. Rigid seal support 46 comprises a seal support ring **46*a*, a substantially frustoconical shell member 46*b* and a radially outwardly extending circumferential flange 46*c* which is bolted to a corresponding flange 40*a* extending from the LPT rotor 40. The second seal portion 50 and the seal support 46 are made of Inconel 718**, which is a nickel-based alloy.

The second seal portion 50 has a radially outwardly extending circumferential flange **50*b* and an annular ring portion 50*a* which carries a plurality of axially spaced annular labyrinth seal teeth 50*c*. One side of flange 50*b* of second seal portion 50 abuts a radially outwardly extending circumferential flange 60*a* of a thin-walled duct 60. The other side of flange 50*b* abuts a radially inwardly extending circumferential flange 58*b* of a single-tooth labyrinth seal 54**.

First seal portion 48 is made of honeycomb or similarly compliant material bonded or otherwise fastened in a stepwise manner to the radially inwardly facing surface of seal support ring **46*a*. In the preferred embodiments, the honeycomb material is made of Hastalloy X. The seal teeth 50*c* extend radially outwardly into sealing relationship with the corresponding stepped sealing surfaces 48*a* formed on first seal portion 48**.

The sealing surfaces **48*a* of the honeycomb material are abradable. During rotation of the HPT and LPT rotors, the tips of the seal teeth 50*c* abut the corresponding sealing surfaces 48*a* of the honeycomb material. The sealing surfaces 48*a* are deformed by the seal teeth during rotation of the rotors into an essentially zero tolerance fit with the seal teeth, thereby reducing the flow of hot gases from pressurized cavity 44 through the seal 42. The honeycomb material also discourages hot gas flow through any gap between sealing surfaces 48*a* and seal teeth 50*c***.

Figure 3:
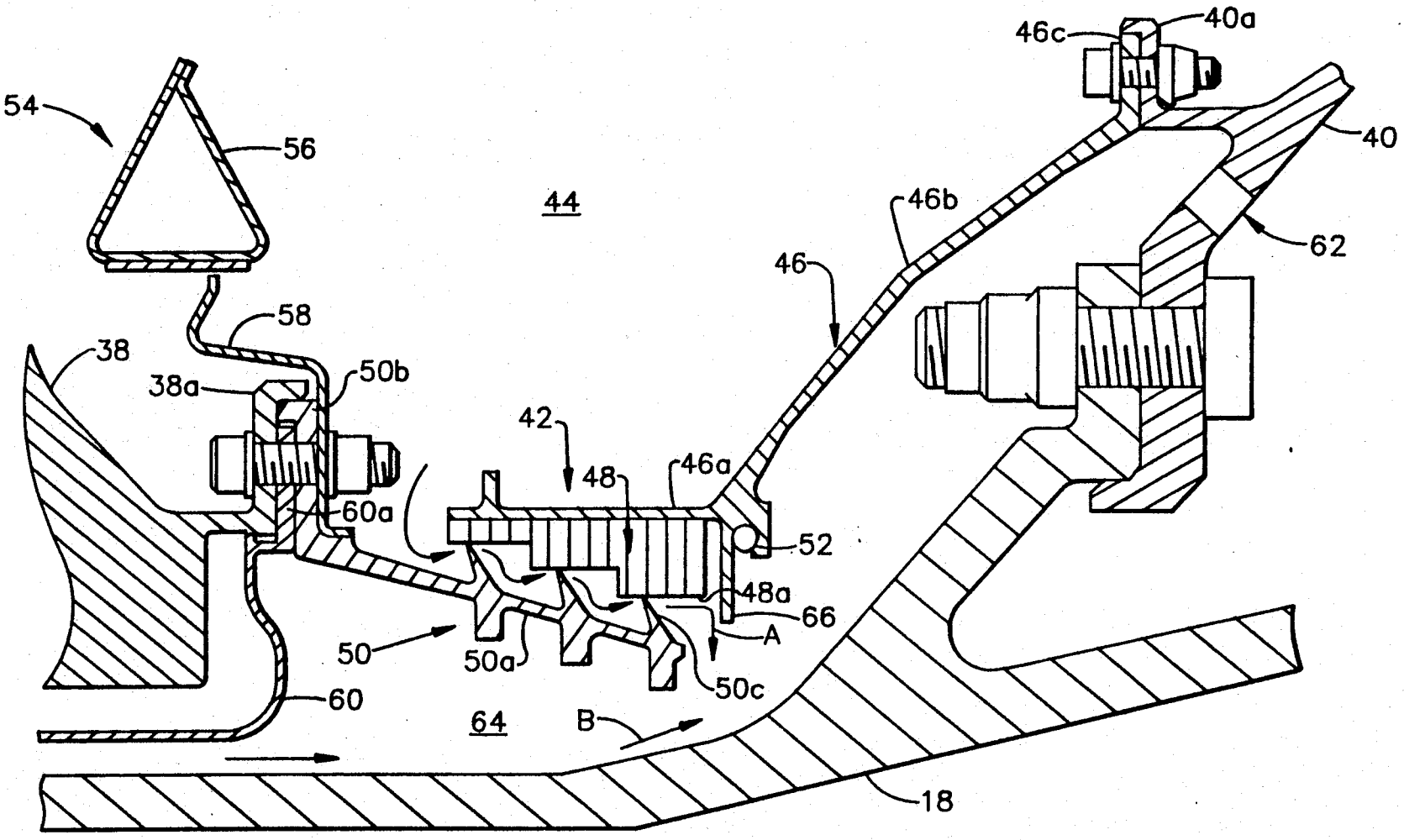
FIGS. 3 and 4 are cross-sectional views of labyrinth seal arrangements respectively incorporating first and second preferred embodiments of the present invention.
Figure 4:
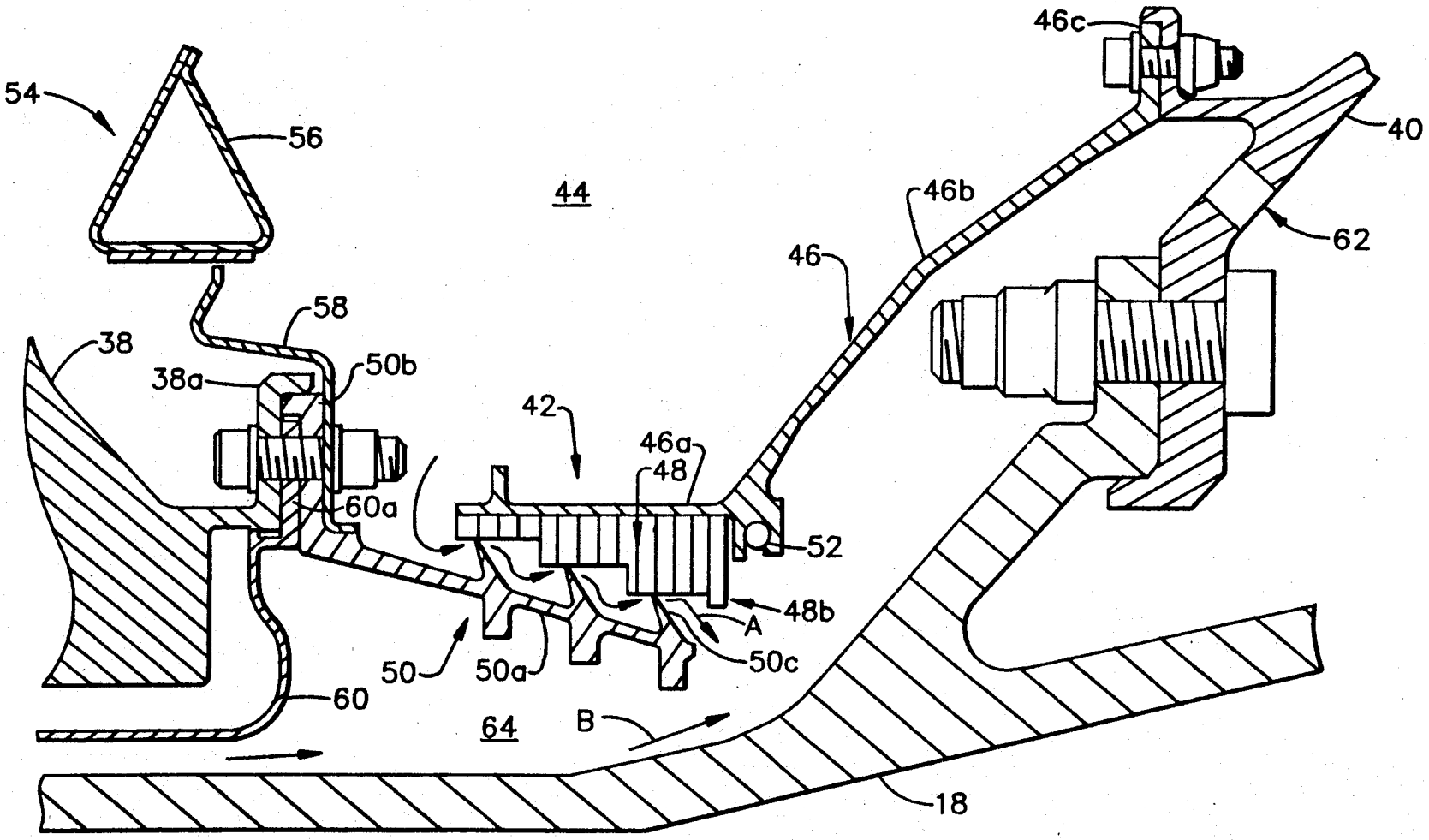

Duct 60 defines an annular passageway surrounding the LPT shaft 18 through which flows cooling air from the compressor. The flow of cooling air is indicated in FIGS. 2-4 by the arrow labeled B. This cooling air is destined to cool the LPT rotor via a multiplicity of apertures 62 circumferentially distributed along an annular portion of the LPT rotor 40 located between the flange 40*b*, by means of which LPT rotor 40 is mounted on LPT shaft 18, and the flange 40*a*.

Labyrinth seal 54 comprises a first sealing portion 56 having a box-like end structure of triangular cross section to provide stiffness and a second sealing portion 58 which carries the single tooth 58*a* as well as flange 58*b*. The single-tooth labyrinth seal 54 is designed to reduce the volume of hot gases entering pressurized cavity 44.

Flanges 58*b*, 50*b*, and 60*a* are bolted in a sandwich arrangement to a corresponding flange 38*a* extending from the HPT rotor 38.

The frustoconical shell member 46*b* has an annular seat for receiving a severed vibration-damping ring 52 of the type disclosed in U.S. Pat. No. 3,589,475 to Alford, discussed hereinabove. The disclosure of the Alford patent, which is commonly assigned to the assignee of the present application, is specifically incorporated by reference herein.

During operation of a gas turbine engine incorporating the structure of FIG. 2, a high-speed (Mach 1) jet of hot gases, indicated by the arrow labeled A, exits the labyrinth seal 42 due to the very high pressure ratio across the seal. The velocity of the hot gas jet is directed substantially axially at the seal exit. In the absence of the seal exit flow discourager of the present invention, the hot gas jet will impinge directly on area C of the LPT shaft 18, which is made of maraging steel, forming an undesirable local high-temperature zone. This steel is subject to undesirable thermally induced changes at temperatures comparable to the temperature of the hot gas jet, i.e., 1000° F. In the absence of means for isolating the LPT shaft from these effects, undesirable creep and metallurgical changes can occur in the LPT shaft.

In accordance with the invention, this problem is remedied by providing a structure for blocking axial flow of the hot gas jet exiting from the labyrinth seal. A first preferred embodiment of the invention is shown in FIG. 3. One of the flanges which forms the annular seat for the vibration-damping ring 52 is extended radially inwardly such that the radius of its inner circumference is less than the radius of the gap between the aftmost landing 48*a* of the honeycomb material and corresponding seal tooth 50*c*. The resulting flange-like extension 66 blocks the axial flow of hot gases exiting from the seal and diverts the hot gases radially inwardly, i.e., toward the flow of cooling air B in annular passageway 64. The result is turbulent mixing of the cooling air and hot gases and a more uniform temperature distribution of the gases adjacent the LPT shaft. As the mixture flows through passageway 64 and toward apertures 62, the LPT shaft is exposed to the mixture of hot gases and cooling air, which has a temperature lower than that of the jet of hot gas exiting the labyrinth seal.

Instead of extending the structure supporting the seal, the same result can be obtained by machining the aftmost land of the honeycomb material, thereby forming a steplike discourager. In accordance with this second preferred embodiment, the honeycomb material 48—not the seal support 46—is radially inwardly extended to block axial flow of the hot gas jet exiting seal 42. As shown in FIG. 4, a radial extension 48*b* is formed immediately downstream of the gap between the aftmost land 48*a* of the honeycomb material and corresponding seal tooth 50*c*. Honeycomb extension 48*b* serves the same function as extension 66 of the embodiment shown in FIG. 3, i.e., to block the axial flow of hot gases exiting from seal 42 and divert the hot gases radially inwardly to mix with the cooling air B flowing in annular passageway 64.

The preferred embodiments have been described in detail hereinabove for the purpose of illustration only. It will be apparent to a practitioner of ordinary skill in the art of gas turbine engines that various modifications could be made to the above-described structure without departing from the spirit and scope of the invention as defined in the claims set forth hereinafter. For example, the seal exit flow discourager of the invention need not be an integrally formed extension of an existing component. Instead the same function could be performed by a separate annular ring designed for attachment to the seal support 46.

Moreover, the invention has applicability beyond labyrinth seals having two rotating members. In general, the invention is also applicable to a labyrinth seal having one rotating member and one stationary member.

Finally, the technology of the invention could be applied with equally advantageous effect to seals other than labyrinth seals, for example, carbon seals, brush seals and hydrodynamic face seals in which gases exit from the seal at high velocity.

I claim:

1. In an axial flow gas turbine engine comprising a compressor for receiving ambient air, a combustor which receives compressed air from said compressor and fuel from a fuel supply, and first and second turbines which receive combustion products produced by said combustor, and further comprising a first annular cavity which receives combustion products produced by said combustor and a second annular cavity surrounding a shaft which receives cooling air from said compressor, said shaft being connected to said second turbine, said first and second annular cavities communicating across a seal, the improvement wherein means are provided for diverting the flow of combustion products existing said seal radially inward to turbulently mix with cooling air flowing through said second annular cavity, wherein said means for diverting produces a more uniform temperature distribution of gases adjacent to said shaft.

2. The gas turbine engine as defined in claim 1, said first and second turbines having rotors which rotate at different speeds, wherein said seal comprises first circumferential sealing means attached to said rotor of said first turbine and second circumferential sealing means attached to said rotor of said second turbine, said second circumferential sealing means being arranged in opposition to said first circumferential sealing means, a running clearance of predetermined radius being defined by said first and second circumferential sealing means, wherein said shaft comprises a low-pressure turbine shaft, wherein said means for diverting enhances a creep capability of said low-pressure turbine shaft.

3. The gas turbine engine as defined in claim 2, wherein said second circumferential sealing means comprises honeycomb material bonded to an annular seal support, said annular seal support being secured to said rotor of said first turbine and said first circumferential sealing surface being formed by a surface of said honeycomb material.

4. The gas turbine engine as defined in claim 3, wherein said flow diverting means comprises a radially inwardly extending flange integrally formed on said annular seal support, said flange having an inner peripheral edge of radius less than said predetermined radius of said running clearance.

5. The gas turbine engine as defined in claim 3, wherein said flow diverting means comprises a radially inwardly extending step integrally formed on said surface of said honeycomb material, said step having an inner peripheral edge of radius less than said predetermined radius of s id running clearance.

6. A seal comprising:

first circumferential sealing means rotatable about an axis of rotation;

second circumferential sealing means arranged in opposition to said first circumferential sealing means and having an axis of symmetry co-linear with said axis of rotation; and circumferential seal exit flow discouraging means having an axis of symmetry co-linear with said axis of rotation and having a substantially annular surface for diverting a flow of relatively hot gases exiting from between said first and second circumferential sealing means toward a flow of relatively cool air thereby causing a turbulent mixing of the relatively hot gases and the relatively cool air; and wherein said second circumferential sealing means comprises a first circumferential sealing surface and wherein said seal exit flow discouraging means comprises an extension integrally formed on said first circumferential sealing surface.

7. The seal as defined in claim 6, wherein said first circumferential sealing means is mounted on a high-pressure turbine rotor of a gas turbine engine for rotation therewith and comprises a first circumferential tooth, and said second circumferential sealing means is mounted on a low-pressure turbine rotor of said gas turbine engine for rotation therewith, a running clearance of predetermined radius being defined by a circumferential tip of said first circumferential tooth and by said first circumferential sealing surface; and wherein said seal exit discouraging means produces a more uniform temperature distribution of gases adjacent a low-pressure turbine shaft connected to said low-pressure turbine rotor.

8. The seal as defined in claim 7, wherein said second circumferential sealing means comprises honeycomb material bonded to an annular seal support, said annular seal support being secured to said low-pressure turbine rotor and said first circumferential sealing surface being formed by a surface of said honeycomb material.

9. The seal as defined in claim 8, wherein said extension comprises a radially inwardly extending step integrally formed on said surface of said honeycomb material, said step having an inner peripheral edge of radius less than said predetermined radius of said running clearance.

10. A seal arrangement for incorporation between first and second components of an axial flow gas turbine engine, wherein each of said first and second components undergoes rotation abut an axis of rotation during operation of said engine, comprising:

first circumferential sealing means attached to said first component and rotatable therewith;

second circumferential sealing means attached to said second component and rotatable therewith and arranged in opposition to said first circumferential sealing means; and seal exit flow discouraging means for diverting a flow of relatively hot gases exiting from between said first and second circumferential sealing means toward a flow of relatively cool air flowing through an annular passageway formed between said first circumferential sealing means and an axially extending structure connected to said second component; and wherein said seal exit discouraging means causes a turbulent mixing of the relatively hot gases and the relatively cool air which produces a more uniform temperature distribution of gases adjacent to said axially extending structure.

11. The seal arrangement as defined in claim 1, wherein said first component comprises a high-pressure turbine rotor and said second component comprises a low-pressure turbine rotor, said high-pressure and low-pressure turbine rotors rotating at different speeds, wherein said axially extending structure is a low-pressure turbine shaft and wherein the relatively hot gases comprise combustion products produced by a combustor of said axial flow gas turbine engine.

12. The seal arrangement as defined in claim 11, wherein said first circumferential sealing means is mounted on said high-pressure turbine rotor for rotation therewith and comprises a first circumferential seal tooth, and said second circumferential sealing means is mounted on said low-pressure turbine rotor for rotation therewith and comprises a first circumferential sealing surface, a running clearance of predetermined radius being defined by a circumferential tip of said first circumferential seal tooth and by said first circumferential sealing surface.

13. The seal arrangement as defined in claim 12, wherein said second circumferential sealing means comprises honeycomb material bonded to an annular seal support, said annular seal support being secured to said low-pressure turbine rotor and said first circumferential sealing surface being formed by a surface of said honeycomb material.

14. The seal arrangement as defined in claim 13, wherein said seal exit flow discouraging means comprises a radially inwardly extending flange integrally formed on said annular seal support, said flange having an inner peripheral edge of radius less than said predetermined radius of said running clearance.

15. The seal arrangement as defined in claim 13, wherein said seal exit flow discouraging means comprises a radially inwardly extending step integrally formed on said surface of said honeycomb material, said step having an inner peripheral edge of radius less than said predetermined radius of said running clearance.

16. The seal arrangement as defined in claim 10, wherein said seal exit flow discouraging means comprises an extension integrally formed on said first circumferential sealing surface.

17. The seal arrangement as defined in claim 10, wherein said seal exit flow discouraging means comprises an extension integrally formed on said second circumferential sealing means.

* * * * *